US009450288B2

(12) United States Patent
Ruan et al.

(10) Patent No.: US 9,450,288 B2
(45) Date of Patent: Sep. 20, 2016

(54) BROADBAND ANTENNA AND WIRELESS COMMUNICATION DEVICE INCLUDING THE SAME

(71) Applicant: Wistron NeWeb Corp., Hsinchu County (TW)

(72) Inventors: Wei-Hung Ruan, Hsinchu County (TW); Wen-Chuan Fan, Hsinchu County (TW)

(73) Assignee: WISTRON NEWEB CORP., Hsinchu County (TW)

( * ) Notice: Subject to any disclaimer, the term of this patent is extended or adjusted under 35 U.S.C. 154(b) by 196 days.

(21) Appl. No.: 13/904,594

(22) Filed: May 29, 2013

(65) Prior Publication Data

US 2014/0139377 A1 May 22, 2014

(30) Foreign Application Priority Data

Nov. 20, 2012 (TW) ..... 101143248 A

(51) Int. Cl.

| | |
|---|---|
| ***H01Q 5/10*** | (2015.01) |
| ***H01Q 9/04*** | (2006.01) |
| ***H01Q 1/22*** | (2006.01) |
| ***H01Q 1/36*** | (2006.01) |

(Continued)

(52) U.S. Cl.

CPC ..... *H01Q 1/2266* (2013.01); *H01Q 1/36* (2013.01); *H01Q 5/371* (2015.01); *H01Q 9/42* (2013.01)

(58) Field of Classification Search

CPC ..... H01Q 9/04; H01Q 9/42; H01Q 1/2266; H01Q 5/371; H01Q 1/36

USPC ..... 343/700, 702

See application file for complete search history.

(56) References Cited

U.S. PATENT DOCUMENTS 6,778,144 B2 * 8/2004 Anderson ..... H01Q 13/106 343/767
7,825,863 B2 * 11/2010 Martiskainen ..... H01Q 1/243 343/700 MS
7,830,326 B2 * 11/2010 Hung ..... H01Q 1/2291 343/826

(Continued)

FOREIGN PATENT DOCUMENTS

CN 101953022 A 1/2011
CN 102055061 A 5/2011

(Continued)

OTHER PUBLICATIONS

Taiwanese Search Report for Taiwanese Patent Application No. 101143248 (issued Jun. 12, 2015).

(Continued)

*Primary Examiner* — Sue A Purvis
*Assistant Examiner* — Bamidele A Jegede
(74) *Attorney, Agent, or Firm* — Merchant & Gould P.C.

(57) ABSTRACT

A broadband antenna includes first and second radiating conductors. The first radiating conductor includes a short-circuit portion in a serpentine shape, a first radiating arm resonating in a first frequency band, and a second radiating arm. The second radiating conductor includes a feed-in portion coupling with the first radiating arm, a third radiating arm resonating in a second frequency band, and a fourth radiating arm. At least a part of the third radiating arm is in a serpentine shape, couples with the first radiating arm, and resonates in a third frequency band with the short-circuit portion and the second radiating arm. The fourth radiating arm resonates in a fourth frequency band.

17 Claims, 3 Drawing Sheets

(51) Int. Cl.
*H01Q 9/42* (2006.01)
*H01Q 5/371* (2015.01)

(56) References Cited

U.S. PATENT DOCUMENTS 8,754,817 B1* 6/2014 Kuo ..... H01Q 1/243 343/700 MS
2010/0103069 A1 4/2010 Wang et al.
2010/0328163 A1* 12/2010 Abramov ..... H01Q 1/521 343/702
2011/0227805 A1* 9/2011 Wang ..... H01Q 9/0421 343/848
2011/0291895 A1* 12/2011 Zaila ..... H01Q 1/243 343/702
2012/0262352 A1* 10/2012 Wong ..... H01Q 1/243 343/728

FOREIGN PATENT DOCUMENTS

CN 102468531 A 5/2012
CN 202259671 U 5/2012
TW 201119142 A 6/2011
TW 201121141 A 6/2011
TW 201123610 A 7/2011

OTHER PUBLICATIONS

Chinese Search Report for corresponding Chinese Patent Application No. 201210478752.X (issued Jun. 18, 2015).

* cited by examiner

BROADBAND ANTENNA AND WIRELESS COMMUNICATION DEVICE INCLUDING THE SAME

CROSS-REFERENCE TO RELATED APPLICATION

This application claims priority of Taiwanese Application No. 101143248, filed on Nov. 20, 2012.

BACKGROUND OF THE INVENTION

1. Field of the Invention

The present invention relates to a broadband antenna, more particularly to a broadband antenna covering frequency bands of long-term evolution (LTE).

2. Description of the Related Art

Currently, wireless communication technology is developed toward the fourth generation of mobile phone mobile communication technology standards (4G). Long-term evolution (LTE) now is a common standard for 4G wireless communication. However, conventional broadband antennas may not satisfy frequency band requirements of the LTE standard.

SUMMARY OF THE INVENTION

Therefore, an object of the present invention is to provide a broadband antenna that may cover frequency bands of long-term evolution (LTE) and wireless wide area network (WWAN).

Accordingly, a broadband antenna according to an embodiment of the present invention comprises a first radiating conductor and a second radiating conductor.

The first radiating conductor includes a ground portion, a short-circuit portion, a first radiating arm and a second radiating arm. The short-circuit portion is in a serpentine shape and has two opposite ends, wherein one of the two opposite ends is electrically connected to the ground portion, and the other one of the two opposite ends is away from the ground portion. The first and second radiating arms are electrically connected to the other one of the two opposite ends of the short-circuit portion.

The second radiating conductor is spaced apart from the first radiating conductor, and includes a feed-in portion, a third radiating arm and a fourth radiating arm. The feed-in portion couples with the first radiating arm, and has a feed-in point that is configured to be fed with a radio frequency signal. The third radiating arm is electrically connected to the feed-in portion, at least a part of the third radiating arm is in a serpentine shape, and at least a part of the third radiating arm couples with the first radiating arm. The fourth radiating arm is electrically connected to the feed-in portion.

The first radiating arm resonates in a first frequency band. The third radiating arm resonates in a second frequency band. The part of the third radiating arm that is in a serpentine shape, the short-circuit portion and the second radiating arm resonate in a third frequency band. The fourth radiating arm resonates in a fourth frequency band.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
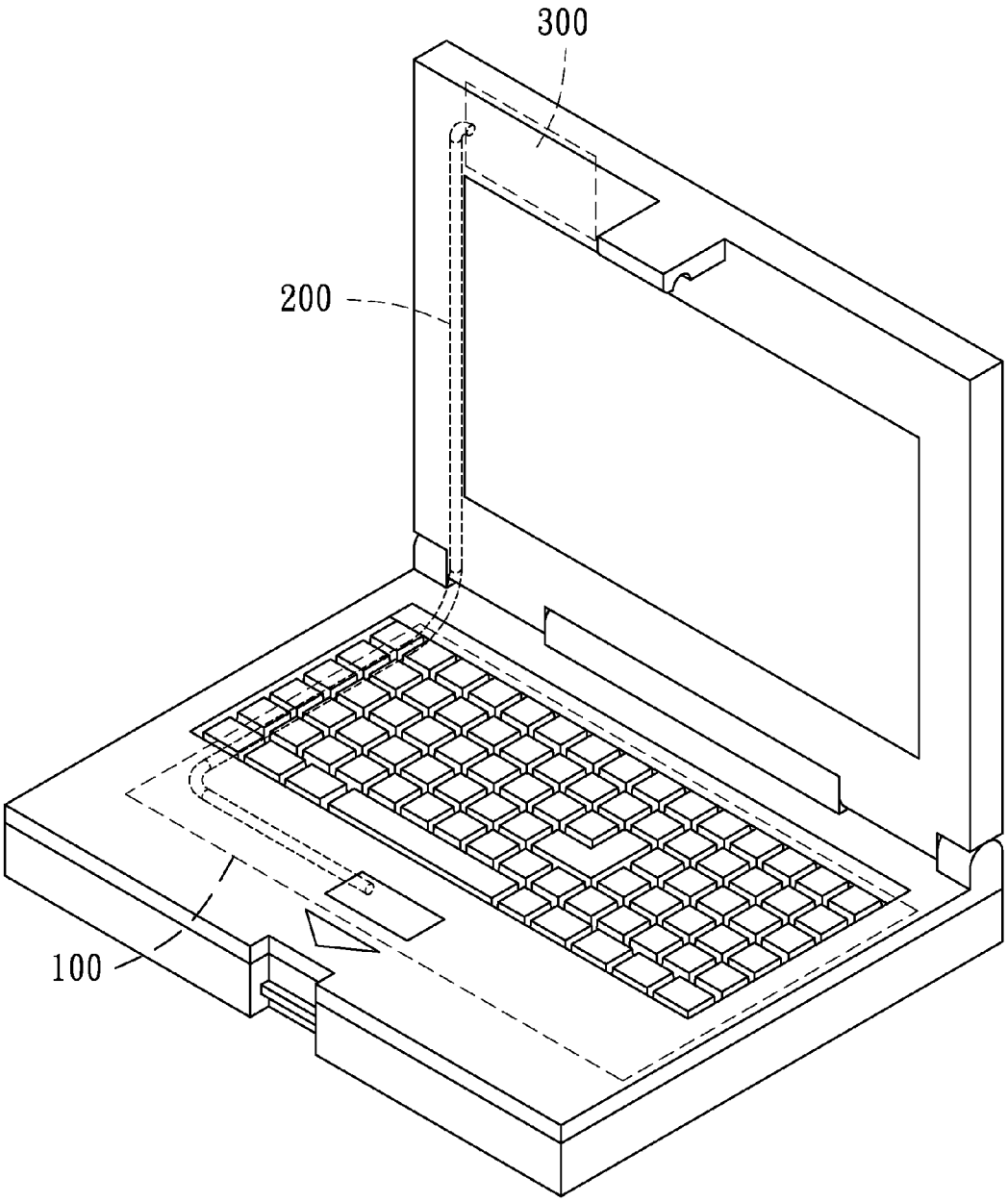
FIG. 1 is a perspective view of a wireless communication device according to an embodiment of the present invention.

Before the present invention is described in greater detail, it should be noted that like elements are denoted by the same reference numerals throughout the disclosure.

Referring to FIG. 1, a wireless communication device according to an embodiment of the present invention is shown to include a communication module 100, a feed element 200 and a broadband antenna 300. The wireless communication device may be a mobile communication device, such as a smart phone, a notebook computer, a tablet computer, a portable navigation device, etc. In this embodiment, the wireless communication device is exemplified as a notebook computer. The communication module 100 is for generating a radio frequency (RF) signal. The feed element 200 is electrically connected between the communication module 100 and the broadband antenna 300 for transferring the RF signal transmitted from the communication module 100 to the broadband antenna 300. The feed element 200 in this embodiment is a coaxial cable.

The broadband antenna 300 shown in FIG. 1 is disposed at a top portion of a display of the wireless communication device. However, those skilled in the art may readily appreciate that the position of the broadband antenna 300 shown in FIG. 1 is merely for illustrative purpose and the present invention is not limited to the disclosure of this embodiment. In practice, the broadband antenna 300 may be disposed at a bottom portion of the display, a side of a keyboard, a hinge part of the display, or any other position.

Figure 2:
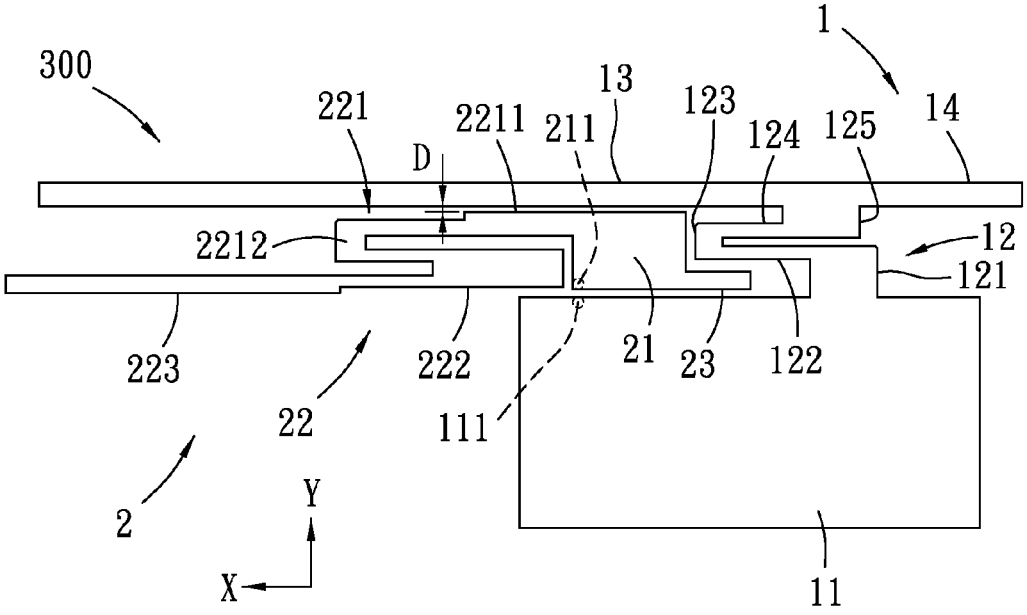
FIG. 2 is a schematic view of a first embodiment of the broadband antenna according to the present invention.

FIG. 2 is a schematic view of a first embodiment of the broadband antenna 300 according to the present invention. Referring to FIG. 2, the broadband antenna 300 includes a first radiating conductor 1 and a second radiating conductor 2 spaced apart from the first radiating conductor 1. The first radiating conductor 1 includes a ground portion 11, a short-circuit portion 12, a first radiating arm 13 and a second radiating arm 14. The ground portion 11 is a substantially rectangular conductor, and has a ground end 111. The ground end 111 is electrically connected to the feed element 200 (see FIG. 1) for receiving a ground signal.

The short-circuit portion 12 is made of a metal, is in a serpentine shape, and is electrically connected to the ground portion 11. The short-circuit portion 12 has a first segment 121, a second segment 122, a third segment 123, a fourth segment 124 and a fifth segment 125. The first segment 121 is electrically connected to and extends from the ground portion 11 in a Y direction. The second segment 122 is electrically connected to and extends from a distal end of the first segment 121 opposite to the ground portion 11 in an X direction that is substantially perpendicular to the Y direction. The third segment 123 is electrically connected to and extends from a distal end of the second segment 122 opposite to the first segment 121 in the Y direction. The fourth segment 124 is electrically connected to and extends from a distal end of the third segment 123 opposite to the second segment 122 in a −X direction that is substantially opposite to the X direction. The fifth segment 125 is electrically connected to and extends from a distal end of the fourth segment 124 opposite to the third segment 123 in the Y direction. The first and second radiating arms 13, 14 are electrically connected to and extend from a distal end of the fifth segment 125 opposite to the fourth segment 124 in the X direction and the −X direction, respectively.

The second radiating conductor 2 includes a feed-in portion 21, a third radiating arm 22 and a fourth radiating arm 23. The feed-in portion 21 is a substantially rectangular conductor, and has a feed-in point 211. The feed-in point 211 is electrically connected to the feed element 200 (see FIG. 1) for receiving the RF signal. The feed-in portion 21 is disposed close to the first radiating arm 13, and couples therewith. In particular, the feed-in portion 21 is disposed between the first radiating arm 13 and the ground portion 11 and close to the short-circuit portion 12 in the X direction. The third and fourth radiating arms 22, 23 are electrically connected to and extend from two opposite sides of the feed-in portion 21 in the X and −X directions, respectively. At least a part of the third radiating arm 22 is in a serpentine shape, and at least apart of the third radiating arm 22 couples with the first radiating arm 13.

In this embodiment, the third radiating arm 22 includes a first radiating segment 221, a second radiating segment 222 and a third radiating segment 223. The first radiating segment 221 is substantially L-shaped and is electrically connected to the feed-in portion 21. The first radiating segment 221 has a first portion 2211 electrically connected to the feed-in portion 21 and coupling with the first radiating arm 13, and a second portion 2212 electrically connected and perpendicular to the first portion 2211. The first portion 2211 of the first radiating segment 221 of the third radiating arm 22 and the feed-in portion 21 are spaced apart from the first radiating arm 13 by a coupling gap (D) ranging from 0.4 mm to 0.8 mm. The second radiating segment 222 is substantially U-shaped, and has two opposite ends, one of which is electrically connected to the second portion 2212 of the first radiating segment 221. The third radiating segment 223 is electrically connected to and extends from another one of the opposite ends of the second radiating segment 222 in the X direction. The first and second radiating segments 221, 222 cooperate to form a serpentine or sinuous S-shape.

In operation, the first radiating arm 13 resonates in a first frequency band, the third radiating arm 22 resonates in a second frequency band, the second radiating segment 222 of the third radiating arm 22, the short-circuit portion 12 and the second radiating arm 14 resonate in a third frequency band, and the fourth radiating arm 23 resonates in a fourth frequency band. In this embodiment, the first frequency band ranges from 704 MHz to 787 MHz, the second frequency band ranges from 824 MHz to 960 MHz, the third frequency band ranges from 1710 MHz to 2170 MHz, and the fourth frequency band ranges from 2300 MHz to 2700 MHz. That is to say, the first and third radiating arms 13, 22 are configured to generate a low-frequency resonant mode (704 MHz to 960 MHz), and the second radiating segment 222 of the third radiating arm 22, the short-circuit portion 12, and the second and fourth radiating arms 14, 23 are configured to generate a high-frequency resonant mode (1710 MHz to 2700 MHz). Accordingly, the broadband antenna 300 may cover frequency bands of both long-term evolution (LTE) and wireless wide area network (WWAN). It is noted that, by virtue of the serpentine shape of the short-circuit portion 12, a length of the first radiating arm 13 in the X direction may be relatively short, and the short-circuit portion 12 is able to generate the high-frequency resonant mode. Similarly, by virtue of the serpentine shape of the third radiating arm 22, the third radiating arm 22 may have a relatively short length in the X direction, and is able to generate the high-frequency resonant mode.

Figure 3:
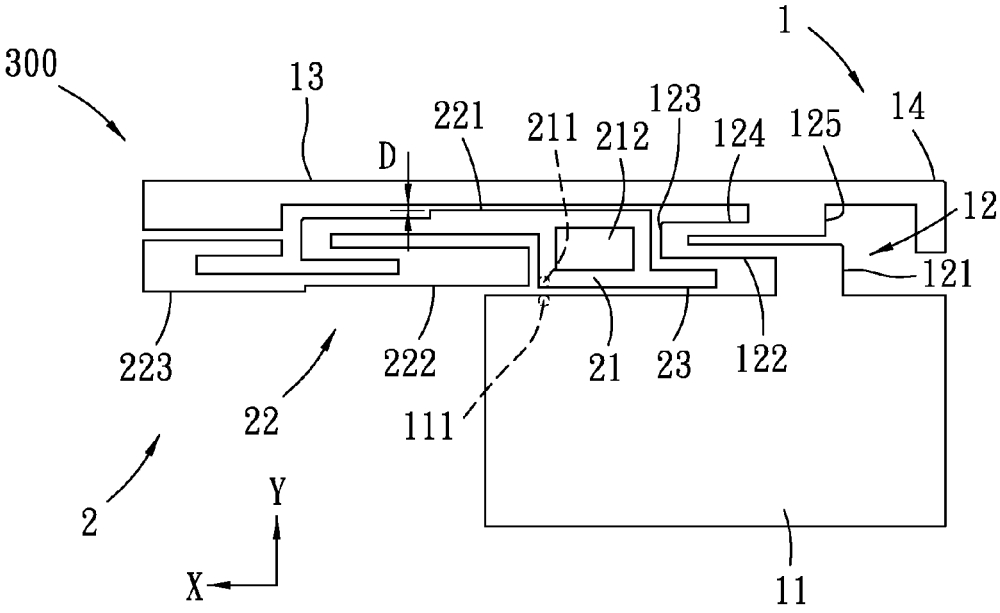
FIG. 3 is a schematic view of a second embodiment of the broadband antenna according to the present invention.

Referring to FIG. 3, a schematic view of a second embodiment of the broadband antenna 300 according to the present invention is shown. The second embodiment is similar to the first embodiment. In the second embodiment, the third radiating segment 223 of the third radiating arm 22 is substantially U-shaped, and the first and second radiating arms 13, 14 are substantially L-shaped. As a result of configurations of the third radiating segment 223 as well as the first and second radiating arms 13, 14 in this embodiment, a size of the broadband antenna 300 may be further reduced (e.g., 75×14 mm in this embodiment). Moreover, the feed-in portion 21 of the second radiating conductor 2 in this embodiment is formed with a substantially rectangular cavity 212. The cavity 212 may effectively improve the radiation gain of the broadband antenna 300.

Figure 4:
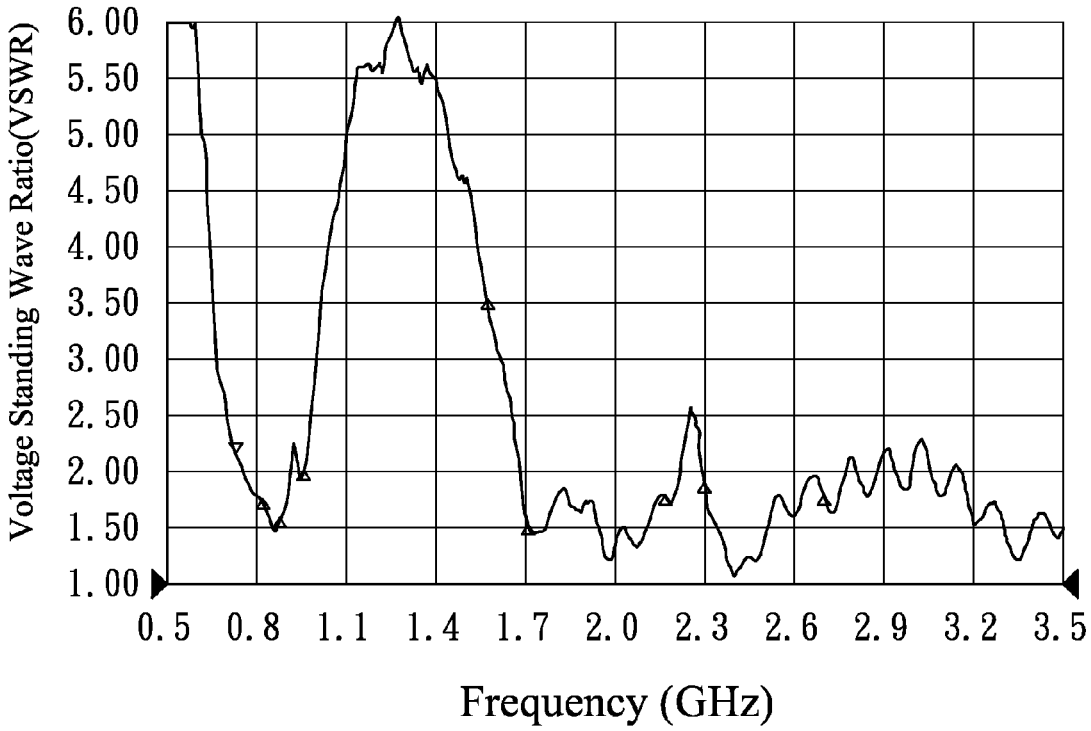
FIG. 4 is a plot showing voltage standing wave ratio of the broadband antenna according to the present invention.

FIG. 4 is a plot showing voltage standing wave ratio (VSWR) of the broadband antenna 300 according to an embodiment of the present invention. FIG. 4 demonstrates that VSWRs of the broadband antenna 300 in both frequency bands of WWAN and LTE are lower than 3.0.

To conclude, the third radiating arm 22 and the short-circuit portion 12 of the broadband antenna 300 according to various embodiments of the present invention are in a serpentine shape, and resonate with the second radiating arm 14 in the third frequency band. In addition, the first, third and fourth radiating arms 13, 22, 23 resonate in the first, second and fourth frequency bands, respectively. Therefore, the broadband antenna 300 and the wireless communication device including the broadband antenna 300 of various embodiments of the present invention are able to meet the broadband communication standards of both WWAN and LTE, thereby supporting 4G wireless communication.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A broadband antenna comprising:

a first radiating conductor including a ground portion, a short-circuit portion that is in a serpentine shape and that has two opposite ends, one of which is electrically connected to said ground portion, and the other one of which is away from said ground portion, and first and second radiating arms electrically connected to the other one of said two opposite ends of said short-circuit portion, having different lengths, and extending in opposite first and second directions, respectively; and a second radiating conductor spaced apart from said first radiating conductor, said second radiating conductor including a feed-in portion disposed close to and coupling with said first radiating arm, and having a feed-in point configured to be fed with a radio frequency signal, a third radiating arm electrically connected to said feed-in portion and extending from said feed-in portion in the first direction, at least a part of said third radiating arm being in a serpentine shape, at least a part of said third radiating arm being close to and coupling with said first radiating arm, and a fourth radiating arm electrically connected to said feed-in portion, and extending from said feed-in portion in the second direction;

wherein said first, second, third and fourth radiating arms are asymmetric to each other, and wherein said first radiating arm resonates in a first frequency band, said third radiating arm resonates in a second frequency band, said part of said third radiating arm that is in a serpentine shape, said short-circuit portion and said second radiating arm resonate in a third frequency band, and said fourth radiating arm resonates in a fourth frequency band.

2. The broadband antenna as claimed in claim 1, wherein said short-circuit portion has:

a first segment electrically connected to said ground portion;

a second segment substantially perpendicular to said first segment and electrically connected to said first segment opposite to said ground portion;

a third segment substantially perpendicular to said second segment and electrically connected to said second segment opposite to said first segment;

a fourth segment substantially perpendicular to said third segment and electrically connected to said third segment opposite to said second segment; and a fifth segment substantially perpendicular to said fourth segment and electrically connected to said fourth segment opposite to said third segment;

wherein said first and second radiating arms are electrically connected to said fifth segment opposite to said fourth segment.

3. The broadband antenna as claimed in claim 1, wherein said third radiating arm includes a substantially L-shaped first radiating segment electrically connected to said feed-in portion, a substantially U-shaped second radiating segment electrically connected to said first radiating segment in a serpentine shape and resonating in the third frequency band, and a third radiating segment electrically connected to said second radiating segment opposite to said first radiating segment.

4. The broadband antenna as claimed in claim 3, wherein said first radiating segment partially couples with said first radiating arm.

5. The broadband antenna as claimed in claim 3, wherein said third radiating segment is substantially U-shaped, and said first and second radiating arms are substantially L-shaped.

6. The broadband antenna as claimed in claim 1, wherein said feed-in portion and said third radiating arm couple with and are spaced apart from said first radiating arm by a coupling gap ranging from 0.4 mm to 0.8 mm.

7. The broadband antenna as claimed in claim 1, wherein said feed-in portion of said second radiating conductor is formed with a cavity.

8. The broadband antenna as claimed in claim 1, wherein the first frequency band ranges from 704 MHz to 787 MHz, the second frequency band ranges from 824 MHz to 960 MHz, the third frequency band ranges from 1710 MHz to 2170 MHz, and the fourth frequency band ranges from 2300 MHz to 2700 MHz.

9. A wireless communication device comprising:

a communication module configured to generate a radio frequency (RF) signal;

a feed element electrically connected to said communication module for transferring the RF signal transmitted from said communication module; and a broadband antenna electrically connected to said feed element, said broadband antenna including a first radiating conductor including a ground portion, a short-circuit portion that is in a serpentine shape and that has two opposite ends, one of which is electrically connected to said ground portion, and the other one of which is away from said ground portion, and first and second radiating arms electrically connected to the other one of said two opposite ends of said short-circuit portion, having different lengths, and extending in opposite first and second directions, respectively, and a second radiating conductor spaced apart from said first radiating conductor, said second radiating conductor including a feed-in portion disposed close to and coupling with said first radiating arm, and having a feed-in point electrically connected to said feed element for receiving the RF signal, a third radiating arm electrically connected to said feed-in portion and extending from said feed-in portion in the first direction, at least a part of said third radiating arm being in a serpentine shape, at least a part of said third radiating arm being close to and coupling with said first radiating arm, and a fourth radiating arm electrically connected to said feed-in portion, and extending from said feed-in portion in the second direction;

wherein said first, second, third and fourth radiating arms are asymmetric to each other, and wherein said first radiating arm resonates in a first frequency band, said third radiating arm resonates in a second frequency band, said part of said third radiating arm that is in a serpentine shape, said short-circuit portion and said second radiating arm resonate in a third frequency band, and said fourth radiating arm resonates in a fourth frequency band.

10. The wireless communication device as claimed in claim 9, wherein said short-circuit portion has:

a first segment electrically connected to said ground portion;

a second segment substantially perpendicular to said first segment and electrically connected to said first segment opposite to said ground portion;

a third segment substantially perpendicular to said second segment and electrically connected to said second segment opposite to said first segment;

a fourth segment substantially perpendicular to said third segment and electrically connected to said third segment opposite to said second segment; and a fifth segment substantially perpendicular to said fourth segment and electrically connected to said fourth segment opposite to said third segment;

wherein said first and second radiating arms are electrically connected to said fifth segment opposite to said fourth segment.

11. The wireless communication device as claimed in claim 9, wherein said third radiating arm includes a substantially L-shaped first radiating segment electrically connected to said feed-in portion, a substantially U-shaped second radiating segment electrically connected to said first radiating segment in a serpentine shape and resonating in the third frequency band, and a third radiating segment electrically connected to said second radiating segment opposite to said first radiating segment.

12. The wireless communication device as claimed in claim 11, wherein said first radiating segment partially couples with said first radiating arm.

13. The wireless communication device as claimed in claim 11, wherein said third radiating segment is substantially U-shaped, and said first and second radiating arms are substantially L-shaped.

14. The wireless communication device as claimed in claim 9, wherein said feed-in portion and said third radiating arm couple with and are spaced apart from said first radiating arm by a coupling gap ranging from 0.4 mm to 0.8 mm.

15. The wireless communication device as claimed in claim 9, wherein said feed-in portion of said second radiating conductor is formed with a cavity.

16. The wireless communication device as claimed in claim 9, wherein the first frequency band ranges from 704 MHz to 787 MHz, the second frequency band ranges from 824 MHz to 960 MHz, the third frequency band ranges from 1710 MHz to 2170 MHz, and the fourth frequency band ranges from 2300 MHz to 2700 MHz.

17. A broadband antenna comprising:

a first radiating conductor including a ground portion, a short-circuit portion being in a serpentine shape, and having a first segment that is electrically connected to said ground portion, a second segment that from said first segment in a first direction, a third segment that extends from said second segment in a second direction substantially perpendicular to the first direction and away from said ground portion, a fourth segment that extends from said third segment in a third direction substantially opposite to the first direction, and a fifth segment that extends from said fourth segment in the second direction, a first radiating arm extending from said fifth segment in the first direction, said second, third and fourth segments being disposed between said ground portion and said first radiating arm, and a second radiating arm extending from said fifth segment in the third direction; and a second radiating conductor spaced apart from said first radiating conductor, said second radiating conductor including a feed-in portion coupling with said first radiating arm, and having a feed-in point configured to be fed with a radio frequency signal, a third radiating arm electrically connected to said feed-in portion, at least a part of said third radiating arm being in a serpentine shape, at least a part of said third radiating arm coupling with said first radiating arm, and a fourth radiating arm electrically connected to said feed-in portion;

wherein said first radiating arm resonates in a first frequency band, said third radiating arm resonates in a second frequency band, said part of said third radiating arm that is in a serpentine shape, said short-circuit portion and said second radiating arm resonate in a third frequency band, and said fourth radiating arm resonates in a fourth frequency band.

* * * * *